US007703898B2

(12) United States Patent
Klein Meuleman et al.

(10) Patent No.: US 7,703,898 B2
(45) Date of Patent: Apr. 27, 2010

(54) INK JET DEVICE WITH PURGING DEVICE

(75) Inventors: Peter Klein Meuleman, Venlo (NL); Christian P. M. Van Zoest, Venlo (NL)

(73) Assignee: Océ-Technology B.V., Venlo (NL)

( * ) Notice: Subject to any disclaimer, the term of this patent is extended or adjusted under 35 U.S.C. 154(b) by 680 days.

(21) Appl. No.: 11/598,008

(22) Filed: Nov. 13, 2006

(65) Prior Publication Data

US 2007/0109366 A1 May 17, 2007

(30) Foreign Application Priority Data

Nov. 14, 2005 (EP) ..... 05110682

(51) Int. Cl.
*B41J 2/175* (2006.01)

(52) U.S. Cl. ..... 347/85

(58) Field of Classification Search ..... 347/7, 347/84, 85, 88, 99

See application file for complete search history.

(56) References Cited

U.S. PATENT DOCUMENTS 3,720,473 A * 3/1973 Nakata ..... 401/40
4,641,154 A 2/1987 Mikalsen
4,788,556 A 11/1988 Hoisington et al.
4,814,786 A 3/1989 Hoisington et al.
4,937,598 A 6/1990 Hine et al.
5,367,328 A * 11/1994 Erickson ..... 347/7
5,489,925 A 2/1996 Brooks et al.
6,048,057 A 4/2000 Kanemoto et al.
6,698,870 B2 * 3/2004 Gunther ..... 347/85
7,311,389 B1 * 12/2007 Pidgeon ..... 347/89

* cited by examiner

*Primary Examiner*—Anh T. N. Vo
(74) *Attorney, Agent, or Firm*—Birch, Stewart, Kolasch & Birch LLP

(57) ABSTRACT

An ink jet device with an ink reservoir and a jetting assembly, with an ink supply line being arranged to allow liquid ink to flow through the valve into the ink reservoir in accordance with and supported by gravity acting on the flowing ink, and a purging device adapted to apply a purging pressure to an inner space of the ink reservoir, wherein a passive one-way valve is arranged below a nominal minimal fill level (L) of the ink reservoir for blocking a connection of the ink supply line to the ink reservoir when a pressure within the ink reservoir is high enough but not required to be higher than the purging pressure.

10 Claims, 2 Drawing Sheets

INK JET DEVICE WITH PURGING DEVICE

This application claims the priority benefit of European Patent Application No. 05110682.1 filed Nov. 14, 2005 which is hereby incorporated by reference.

BACKGROUND OF THE INVENTION

The present invention relates to an ink jet device comprising an ink reservoir and a jetting assembly having at least one printing nozzle.

In an ink jet device, for example an ink jet printer with an ink reservoir and a jetting assembly, the ink reservoir is usually arranged together with the jetting assembly in a printhead which is reciprocated over a printing area. When ink is also stored outside the reciprocating printhead, the printhead usually has an ink supply line for supplying ink to the ink reservoir. For example, in an ink jet printer operating with hot melt ink, i. e. with ink that is solid at room temperature, the ink supply line may comprise an ink melting unit for supplying melted ink to the ink reservoir, and solid ink pellets may be supplied to an open end of the ink melting unit from outside the printhead from time to time. In order to ensure that contaminants are prevented from entering the ink reservoir, an ink filter may be provided at the ink supply line, and the melted ink may be required to flow through the ink filter into the ink reservoir.

Depending on the configuration of the ink jet device, it may be necessary to provide a suction device for applying a negative pressure to an inner space of the ink reservoir to prevent ink from leaking out of the printing nozzles of the jetting assembly. In this case, the ink filter may function as a hydraulic lock, so that the negative pressure can be provided to the ink reservoir while at the same time ink may be supplied to the ink reservoir through the ink filter.

In order to dispose of air bubbles or contaminants that might be present in the jetting assembly, it is desirable to purge the printing nozzles of the jetting assembly from time to time, thereby removing any air bubbles and contaminants. Therefore, a purging device may be provided that is adapted to apply a purging pressure to the inner space of the reservoir for pressing ink into the printing nozzles. However, in case of an ink supply line having an open end, the ink supply line has to be shut off from the ink reservoir to permit the purging device to build up the necessary purging pressure in the ink reservoir.

The necessary purging pressure is usually higher than the absolute value of the negative pressure which is applied to the ink reservoir for preventing ink from leaking ink out of the printing nozzles. In the case of the ink supply line having an ink filter as described above, the ink filter may not function as a hydraulic lock under the comparatively high purging pressure. Thus, a break-through of the ink filter, i.e., an undesired flow of air or ink from the ink reservoir through the ink filter, may take place. In this case, the necessary purging pressure cannot be built up within the ink reservoir.

From U.S. Pat. No. 4,641,154, an ink jet apparatus having a tilt valve that is positioned at an upper wall of the ink reservoir is known. Hot melt ink is melted in an ink melting unit and flows through the tilt valve into the ink reservoir due to gravity. When a purging pressure is to be built up by an ink jet priming system, the tilt valve is moved to a closed position by an actuator. Thus, the tilt valve has to be actively closed in order to enable the ink jet priming system to build up a purging pressure within the ink reservoir. The necessary actuator for closing the valve and the moving parts of the valve which are arranged at the ink supply line are disadvantageous. A further disadvantage results from the fact that the valve is opened by the gravity force of the melted ink as the opening of the valve may be suppressed by capillary forces, i.e., adhesion between the valve element, the liquid ink and the top wall of the reservoir. In such a case, the ink supply line will be blocked.

From U.S. Pat. No. 6,048,057, a hot melt ink jet printhead is known having an ink reservoir with a first chamber and a second chamber. The second chamber comprises a first valve and a second valve. In the normal printing operation of the printhead, ink flows from the first chamber to a nozzle head of the printhead. During a purging operation, a channel between the first chamber and the second chamber is closed, and a channel between the nozzle head and the second chamber is opened. Then, ink flows from the first chamber through the nozzle head into the second chamber. Accordingly, any air bubbles present in the nozzle head are moved into the second chamber. During the normal printing operation, ink is allowed to flow from the second chamber to the first chamber. The valves are arranged at opposite arms of a lever to be alternately closed by a movement of the lever. The lever is activated by an actuating mechanism. A disadvantage is that always one of the valves is in a closed position, so that during printing the ink is not circulated in the chamber between the nozzle head and the second chamber. Moreover, the valves do not shut off the ink supply line from the ink reservoir.

From U.S. Pat. No. 5,489,925, an ink jet printing system is known, wherein a liquid ink supply line extending from a remote liquid ink reservoir to an ink reservoir of a printhead is shut off by a passive check valve. The check valve is spring-biased toward its closed position. The ink reservoir of the printhead may be elevated above the remote reservoir, and ink is supplied through the check valve to the ink reservoir by a pump, thereby opening the check valve. A pressure control system controls the pressure of the ink in the ink reservoir of the printhead to permit purging of air bubbles and contaminants from orifices and passageways. A disadvantage of this ink jet printing system is that a pump is necessary to actively pump the ink through the check valve in the ink supply line.

SUMMARY OF THE INVENTION

It is an object of the present invention to provide an ink jet device that allows a build up of purging pressure within an ink reservoir, and in which the ink supply line is reliably shut off during a purging operation and is reliably opened after the purging operation, without requiring a pump for supplying the ink.

According to the present invention, this object is achieved by an ink jet device comprising an ink reservoir and a jetting assembly having at least one printing nozzle, the jetting assembly being connected to the ink reservoir for receiving liquid ink from the ink reservoir, the ink jet device further comprising an ink supply line for supplying ink to the ink reservoir, said ink supply line comprising a valve for blocking a connection of the ink supply line to the ink reservoir, said valve being arranged at a lower end of the ink supply line. The ink supply line and the ink reservoir are arranged to allow liquid ink to flow through the valve into the ink reservoir in accordance with and supported by gravity acting on the ink. The ink jet device further comprises a purging device adapted to apply a purging pressure to an inner space of the ink reservoir for pressing ink into the at least one printing nozzle, wherein the valve is arranged below a nominal minimal fill level of the ink reservoir. The valve is a passive one-way valve that is adapted to block the connection of the ink supply line to the ink reservoir when a pressure within the ink reservoir reaches a predetermined value. This predetermined pressure value may be a value between the set value of the pressure to be applied to the ink reservoir during printing and the purging pressure set value. Due to the valve, the ink supply line can be reliably shut off from the ink reservoir during the purging operation, so that the purging pressure can be built up within the ink reservoir. Moreover, because the valve is a passive valve that closes when the pressure within the ink reservoir is high enough, wherein said high enough pressure is not required to be higher than the purging pressure, the valve automatically closes when the purging pressure is built up. Therefore, an actuator for closing the valve can be dispensed with.

Moreover, a reliable opening of the valve is achieved for the following reasons. Because the valve is arranged below a nominal minimal fill level of the ink reservoir, the valve is surrounded by the ink of the ink reservoir and by the ink that is present within the ink supply line. Therefore, there will be no capillary adhesion forces that could prevent the valve from opening. Therefore, the valve may be adapted to be opened due to or supported by gravity forces acting on ink which is present in the ink supply line. Furthermore, the valve preferably comprises a valve element which has a greater mass than the ink which it displaces. Thus, the opening of the valve is also supported by gravity acting on the valve element.

Because the liquid ink flows through the valve into the ink reservoir supported by gravity, a pump may be dispensed with. This facilitates a simple construction of the ink jet device.

In a preferred embodiment, the ink supply line further comprises an ink filter, the valve being arranged between the ink filter and the ink reservoir. In this case, the valve of the invention is extremely useful to prevent an ink filter breakthrough due to the purging pressure. Preferably, the only ink path into the ink reservoir is through the ink filter, and, following the ink filter, through the valve. Preferably, the ink filter is arranged above the ink reservoir. In one embodiment, the ink supply line further comprises a sub chamber which is arranged between the ink filter and the valve. Thereby, the gravity force acting on the ink which is present within the sub chamber contributes to opening the valve.

In a preferred embodiment, the ink supply line further comprises an ink melting unit for supplying melted ink through the ink filter to the ink reservoir.

Preferably, the ink jet device comprises a suction device which is adapted to apply a negative pressure to the inner space of the ink reservoir. Thereby, ink may be prevented from leaking from the printing nozzle. In case the ink filter is provided at the ink supply line, the ink filter preferably functions as a hydraulic lock, so that the negative pressure may be applied while still allowing liquid ink to be supplied to the ink reservoir through the filter.

In one embodiment, the valve is adapted to be continuously open during a printing operation of the ink jet device and is adapted to be closed by the purging pressure being applied to said inner space of the ink reservoir.

In a preferred embodiment, the valve comprises a spherical valve element, a cage and a valve seat for the valve element, the valve element being freely movable between the valve seat and the cage, the mass of the valve element being greater than the mass of the liquid ink which is displaced by the valve element. The valve is adapted to be closed when the valve element is pressed against the valve seat. Alternatively, the valve may be a duck bill valve.

Preferably, the cage forms a diffuser for ink which flows through the valve into the ink reservoir. Thereby, a circulation of the liquid ink within the ink reservoir is facilitated.

In a specially preferred embodiment, the ink supply line further comprises a vertical tube, the valve seat being arranged at an inner wall of said tube, the tube surrounding at least an upper half of the valve element when the valve element is pressed against the valve seat. Thereby, during the build up of the purging pressure within the ink reservoir, a momentary movement of ink towards the valve more reliably pushes the valve element against the valve seat.

BRIEF DESCRIPTION OF THE DRAWINGS

A preferred embodiment of the present invention will now be described in conjunction With the drawings in which.

DETAILED DESCRIPTION OF THE INVENTION

Figure 1:
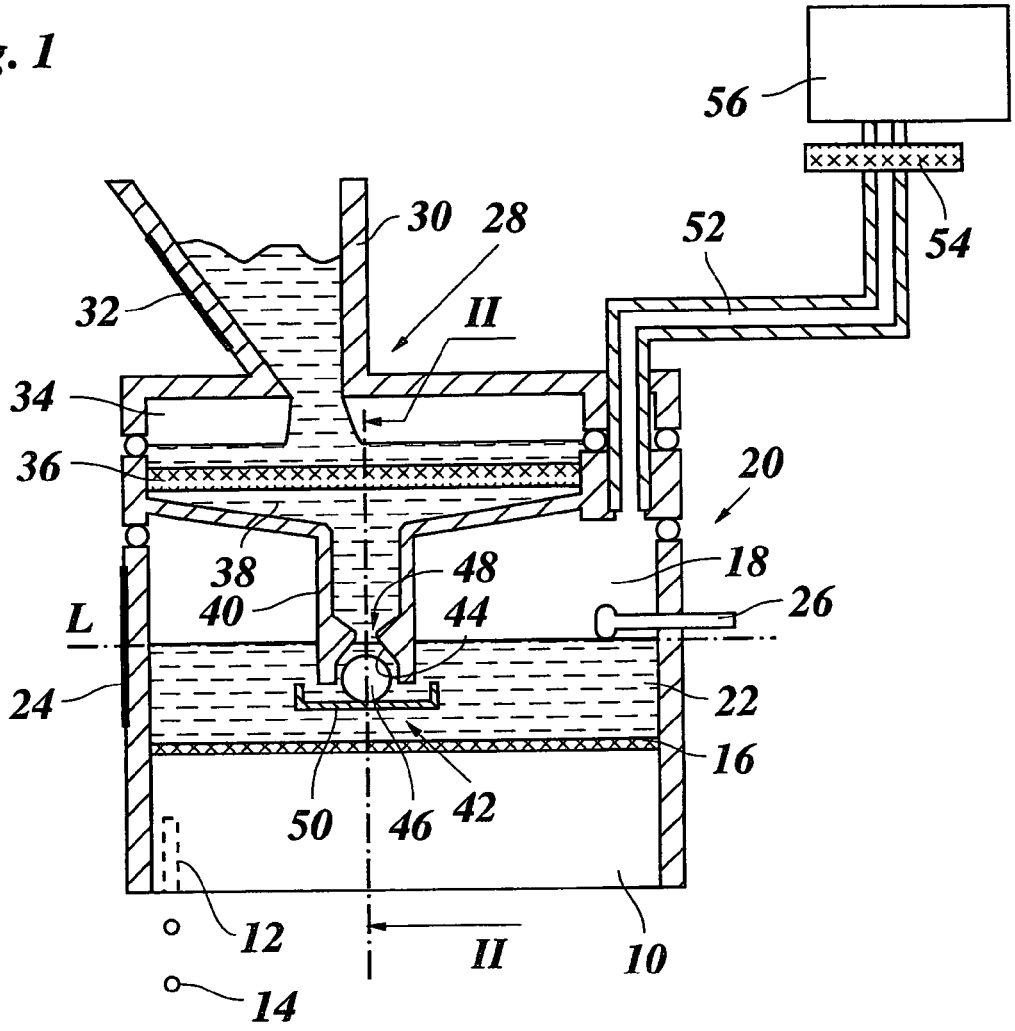
FIG. 1 is a schematic sectional view of an ink jet device with an ink supply line for hot-melt ink.
Figure 2:
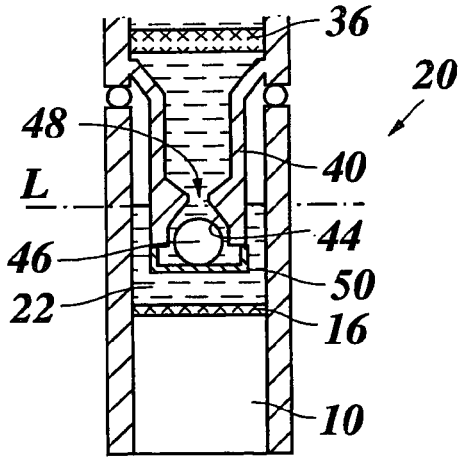
FIG. 2 is a schematic cross-sectional view of the lower part of the ink jet device of FIG. 1 taken along the line II-II.
Figure 3:
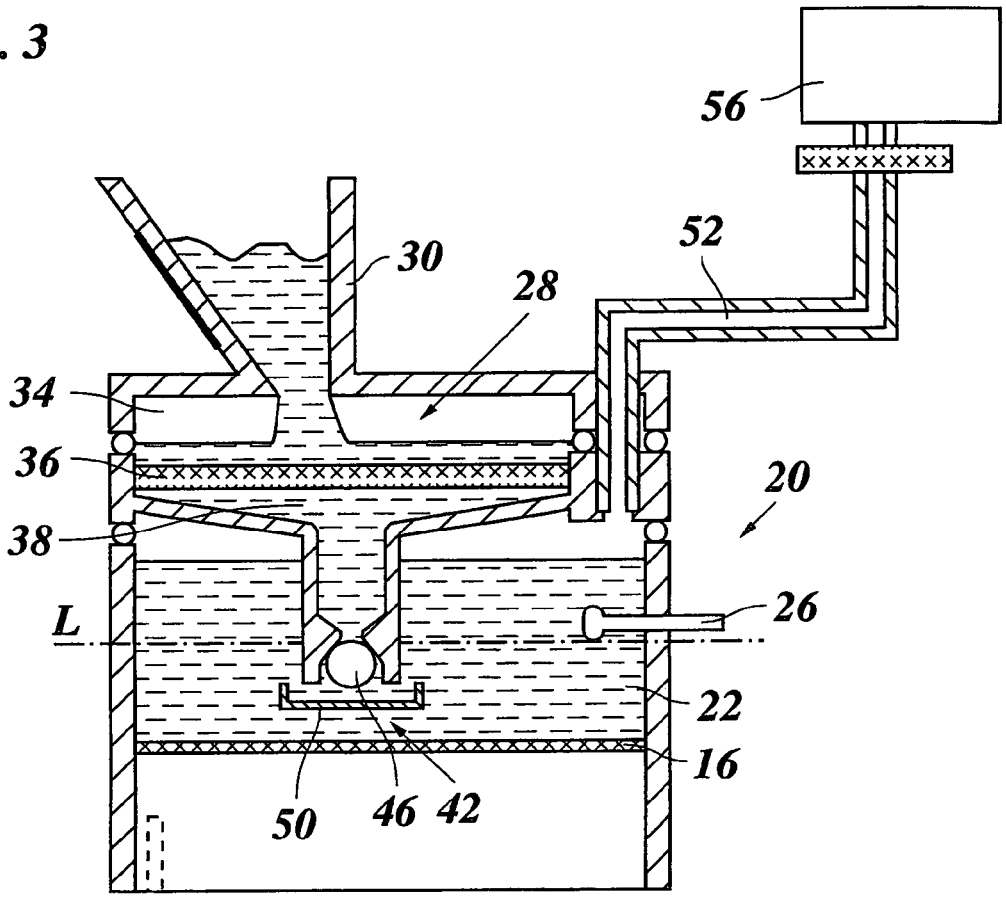
FIG. 3 shows the ink jet device of FIG. 1 during a purging operation.

FIGS. 1 to 3 show an ink jet device with a jetting assembly 10 forming a lower part thereof. An array of printing nozzles 12 is arranged at the jetting assembly 10 to eject ink droplets in a vertical direction. In FIG. 1, one of the printing nozzles 12 is shown, and ink droplets 14 are indicated. The jetting assembly 10 is connected via a filter 16 to an inner space 18 of an ink reservoir 20.

The ink reservoir 20 is normally filled with liquid hot-melt ink 22 at least to a nominal minimal fill level L indicated with a chain-dotted line. An electric heating device 24 is arranged in a manner which is generally known in the art at the ink reservoir 20 to keep the hot-melt ink 22 in its liquid state. A fill level sensor 26 is arranged at a wall of the ink reservoir 20 to detect whether the actual ink fill level within the ink reservoir 20 sinks to nearly the nominal minimal fill level L, like it is shown in FIGS. 1 and 2. In this case, new liquid ink is supplied to the inner space 18 of the ink reservoir 20 via an ink supply line 28. In FIG. 3, an actual fill level is shown that is higher than the actual fill level shown in FIGS. 1 and 2.

Above the ink reservoir 20, there is arranged an ink melting unit 30 of the ink supply line 28. Solid ink pellets are supplied to the ink melting unit 30 when needed. At a wall of the ink melting unit 30, there is arranged an electric heating device 32 for melting the ink pellets which are present in the ink melting unit 30. The ink melting unit 30 forms a funnel which opens at its lower end into a first sub chamber 34 of the ink reservoir 20. The first sub chamber 34 extents substantially over the cross sectional area of the ink reservoir 20. It has a lower wall which is formed by an ink filter 36 which connects the first sub chamber 34 to a second sub chamber 38 which is arranged below the ink filter 36. The upper part of the second sub chamber 38 forms a funnel which is connected to a vertical tube 40 that forms the lower part of the second sub chamber 38. At the lower end of the vertical tube 40, the ink supply line 28 is connected to the inner space 18 of the ink reservoir 20 via a valve 42 which will now be described in detail.

At a lower end of the vertical tube 40, the inner wall of the vertical tube 40 forms a valve seat 44 for a ball which forms a spherical valve element 46. At the valve seat 44, the vertical tube 40 forms a valve opening 48. In a closed position of the valve, the spherical valve element 46 is pressed against the valve seat 44 by a pressure within the ink reservoir 20 and thereby closes the valve opening 48. Thus, the connection of the ink supply line 28 to the ink reservoir 20 is blocked. This state is shown in FIG. 3.

In FIGS. 1 and 2, an open position of the valve is shown wherein the valve element 46 is held by a cage 50 which is arranged at the lower end of the vertical tube 40. The valve element 46 is free to move between the cage 50 and the valve seat 44. Since the valve element 46 has a greater mass than the ink which it displaces, the valve element 46 will usually rest on the cage 50 in the open position of the valve 42. Thereby, the influence of the valve 42 onto the ink flow into the ink reservoir 20 is minimized. However, the vertical tube 40 is arranged to surround at least an upper half of the spherical valve element 46 in the open position of the valve 42. Thereby, when the pressure is built up within the ink reservoir 20, a resultant movement of the ink towards the vertical tube 40 assures that the valve element 46 is pressed against the valve seat 44. In the closed position of the valve 42, the vertical tube 40 surrounds an even larger part of the valve element 46.

An ink flow from the ink supply line 28 through the open valve 42 into the ink reservoir is divided by the cage 50 into at least two branches. Thus, the cage 50 forms a diffuser for the ink flow. Accordingly, the ink enters into the inner space 18 of the ink reservoir 20 in at least two different directions. Thereby, a circulation of the ink 22 within the ink reservoir 20 is achieved. In the embodiment shown, the ink flows through openings between the cage 50 and the vertical tube 40 at two opposite sides of the valve 42, namely, to the left and to the right of the vertical tube 40 in FIG. 1.

At an upper area of the inner space 18 of the ink reservoir 20, there is connected a ventilation conduit 52 to the inner space 18. The ventilation conduit 52 is, for example, formed by a flexible hose. The ventilation conduit 52 connects the inner space 18 of the ink reservoir 20 via an air filter 54 to a combined suction and purging device 56. During a normal printing operation of the ink jet device, the combined suction and purging device 56 applies a negative pressure via the ventilation conduit 52 to the inner space 18. Thereby, liquid ink 22 is prevented from leaking through the printing nozzles 12 of the jetting assembly 10. Under this negative pressure, the ink filter 36 of the ink supply line 28 functions as a hydraulic lock because capillary channels of the ink filter 36 are filled with ink. Thereby, the negative pressure can be maintained within the inner space 18 of the ink reservoir 20. During the printing operation, the valve 42 is continuously open.

When a purging operation of the ink jet device is to be performed, the combined suction and purging device 56 exerts a higher positive pressure to the inner space 18 of the ink reservoir 20. This is called the purging pressure. When the purging pressure is applied to the ink reservoir 20, the valve element 46 is pressed against the valve seat 44 and thus, the valve 42 is closed. Thereby, the connection of the ink supply line 28 to the ink reservoir 20 is locked. Thus, the ink filter 36 does not interfere with the building up of the purging pressure within the inner space 18 of the ink reservoir 20. In particular, a break-through of the ink filter 36 is prevented.

After the purging operation has been performed, the combined suction and purging device 56 may again apply a negative pressure to the inner space 18 of the ink reservoir 20. Due to gravity acting on ink within the vertically tube 40 and due to the negative pressure within the ink reservoir 20, the valve element 46 experiences a force that moves the valve element 46 downward. Because the valve element 46 is arranged below the nominal minimal fill level L, it is surrounded by liquid ink 22 in the closed position of the valve 42. Thereby, capillary adhesion forces are prevented from occurring between the valve element 46 and the valve seat 44. Therefore, after a purging operation the valve 42 reliably opens.

Thus, the valve 42 functions as a passive one-way valve that reliably blocks the connection of the ink supply line 28 to the ink reservoir 20 when the purging pressure is applied to the ink reservoir and reliably opens again when the pressure within the ink reservoir is at its normal level during a printing operation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An ink jet device which comprises:

an ink reservoir and a jetting assembly having at least one printing nozzle, the jetting assembly being connected to the ink reservoir for receiving liquid ink from the ink reservoir, an ink supply line for supplying ink to the ink reservoir, said ink supply line comprising a valve for blocking a connection of the ink supply line to the ink reservoir, said valve being arranged at a lower end of the ink supply line, the ink supply line and the ink reservoir being arranged to allow liquid ink to flow through the valve into the ink reservoir in accordance with and supported by gravity acting on the ink, and a purging device adapted to apply a purging pressure to an inner space of the ink reservoir for pressing ink into the at least one printing nozzle, wherein the valve is arranged below a nominal minimal fill level (L) of the ink reservoir, said valve being a passive one-way valve that is adapted to block the connection of the ink supply line to the ink reservoir when a pressure within the ink reservoir reaches a predetermined value.

2. The ink jet device according to claim 1, wherein the ink supply line further comprises an ink filter, the valve being arranged between the ink filter and the ink reservoir.

3. The ink jet device according to claim 2, wherein the only ink path into the ink reservoir is through the ink filter and, following the ink filter, through the valve.

4. The ink jet device according to claim 2, wherein the ink filter is arranged above the ink reservoir.

5. The ink jet device according to claim 2, wherein the ink supply line further comprises a sub chamber which is arranged between the ink filter and the valve.

6. The ink jet device according to claim 2, wherein the ink supply line further comprises an ink melting unit for supplying melted ink through the ink filter to the ink reservoir.

7. The ink jet device according to claim 1, further comprising a suction device adapted to apply a negative pressure to said inner space of the ink reservoir.

8. The ink jet device according to claim 1, wherein the valve comprises a spherical valve element, a cage and a valve seat for the valve element, the valve element being freely movable between the valve seat and the cage, the mass of the valve element being greater than the mass of the liquid ink which is displaced by the valve element.

9. The ink jet device according to claim 8, wherein the cage forms a diffuser for ink which flows through the valve into the ink reservoir.

10. The ink jet device according to claim 8, wherein the ink supply line further comprises a vertical tube, the valve seat being arranged at an inner wall of said tube, the tube surrounding at least an upper halve of the valve element when the valve element is pressed against the valve seat.

* * * * *